US005362422A

United States Patent [19]

Masters

[11] Patent Number: 5,362,422

[45] Date of Patent: Nov. 8, 1994

[54] LIQUID HARD SURFACE DETERGENT COMPOSITIONS CONTAINING AMPHOTERIC DETERGENT SURFACTANT AND SPECIFIC ANIONIC SURFACTANT

[75] Inventor: Ronald A. Masters, Loveland, Ohio

[73] Assignee: The Procter & Gamble Company, Cincinnati, Ohio

[21] Appl. No.: 56,110

[22] Filed: May 3, 1993

[51] Int. Cl.[5] ..... C11D 1/92

[52] U.S. Cl. ..... 252/544; 252/545; 252/546; 252/558; 252/559; 252/162; 252/170; 252/173; 252/172; 252/DIG. 7; 252/DIG. 14

[58] Field of Search ..... 252/544, 545, 546, 558, 252/559, 162, 170, 171, 172, 173, DIG. 7, DIG. 14

[56] References Cited

U.S. PATENT DOCUMENTS

| | | | |
|---|---|---|---|
| 3,717,590 | 2/1973 | Fetty | 252/170 |
| 4,106,901 | 8/1978 | Bishop et al. | 252/162 |
| 4,414,128 | 11/1983 | Gaffinet | 252/171 |
| 4,704,234 | 11/1987 | Petersen et al. | 252/165 |
| 4,759,867 | 7/1988 | Choy et al. | 252/173 |
| 5,061,393 | 10/1991 | Linares et al. | 252/170 |
| 5,108,660 | 4/1992 | Michael | 252/170 |

*Primary Examiner*—Paul Lieberman
*Assistant Examiner*—Necholus Ogden
*Attorney, Agent, or Firm*—Robert B. Aylor

[57] ABSTRACT

The present invention relates to an aqueous, liquid, hard surface cleaning compositions containing amphoteric/zwitterionic detergent surfactant, specific anionic surfactant, cleaning solvent, optional nonionic detergent surfactant, and buffer. The buffers can be either alkaline or acid for improved cleaning of acid sensitive soils like soap scum and/or hard water deposits. The presence of the specific anionic surfactant permits the inclusion of more of relatively hydrophobic materials like cleaning solvents, which provide improved cleaning, especially under acid conditions where some greasy/oily soils are more difficult to remove.

24 Claims, No Drawings

LIQUID HARD SURFACE DETERGENT COMPOSITIONS CONTAINING AMPHOTERIC DETERGENT SURFACTANT AND SPECIFIC ANIONIC SURFACTANT

FIELD OF THE INVENTION

This invention pertains to liquid detergent compositions for use in cleaning hard surfaces. Such compositions typically contain detergent surfactants, solvents, builders, etc.

BACKGROUND OF THE INVENTION

The use of solvents and organic water-soluble synthetic detergents at low levels for cleaning glass are known.

General purpose household cleaning compositions for hard surfaces such as metal, glass, ceramic, plastic and linoleum surfaces, are commercially available in both powdered and liquid form. Liquid detergent compositions are disclosed in Australian Pat. Application 82/88168, filed Sep. 9, 1982, by The Procter & Gamble Company; U.K. Pat. Application GB 2,166,153A, filed Oct. 24, 1985, by The Procter & Gamble Company; and U.K. Pat. Application GB 2,160,887A, filed Jun. 19, 1985, by Bristol-Myers Company, and U.S. Pat. No. 5,108,660, Michael, issued Apr. 28, 1992, said patent and all of said published applications being incorporated herein by reference. These liquid detergent compositions comprise certain organic solvents, surfactant, and optional builder and/or abrasive.

Liquid cleaning compositions have the great advantage that they can be applied to hard surfaces in neat or concentrated form so that a relatively high level of surfactant material and organic solvent is delivered directly to the soil. Therefore, liquid cleaning compositions have the potential to provide superior soap scum, grease, and oily soil removal over powdered cleaning compositions. Nevertheless, liquid cleaning compositions need even more cleaning ability to improve their consumer acceptability and they have to have good spotting/filming properties. In addition, they can suffer problems of product form, in particular, inhomogeneity and/or lack of clarity.

An object of the present invention is to provide stable liquid detergent compositions which provide good glass cleaning without excessive filming and/or streaking while maintaining good overall cleaning, preferably including soap scum and greasy/oily soils.

SUMMARY OF THE INVENTION

The present invention relates to an aqueous, liquid, hard surface cleaning composition containing amphoteric/zwitterionic detergent surfactant; cleaning solvent at a level that can cause phase separation; specific anionic surfactant, at a level that prevents said phase separation, which does not adversely affect filming/streaking characteristics of the composition; optional nonionic detergent surfactant; and buffer, including volatile organic acid buffer.

All percentages, parts, and ratios herein are "by weight" unless otherwise stated.

DETAILED DESCRIPTION OF THE INVENTION

In accordance with the present invention, it has been found that superior aqueous liquid detergent compositions for cleaning a wide variety of soils and shiny surfaces such as glass contain detergent surfactant which is capable of being amphoteric or, preferably, zwitterionic (containing both cationic and anionic groups in substantially equivalent proportions so as to be electrically neutral at the pH of use, typically either alkaline, e.g., at least about 9.5, preferably at least about 10, or acid, e.g., from about 2 to about 4.5) and buffer, e.g., monoethanolamine and/or certain beta-aminoalkanol compounds and/or volatile organic acids as described hereinafter.

The Detergent Surfactant

The aqueous, liquid hard surface detergent compositions (cleaners) herein contain from about 0.001% to about 15% of suitable amphoteric/zwitterionic detergent surfactant containing both a cationic group, preferably a quaternary ammonium group, and an anionic group, preferably carboxylate, sulfate and/or sulfonate group, more preferably sulfonate. Successively more preferred ranges of amphoteric/zwitterionic detergent surfactant inclusion are from about 0.02% to about 10% of surfactant, and from about 0.1% to about 5% of surfactant.

Amphoteric/zwitterionic detergent surfactants, as mentioned hereinbefore, can contain both a cationic group and an anionic group at at least some pH, and are preferably in substantial electrical neutrality at the typical pH of use, where the number of anionic charges and cationic charges on the detergent surfactant molecule are substantially the same. Amphoteric/zwitterionic detergents, which typically contain both a quaternary ammonium group and an anionic group selected from sulfonate and carboxylate groups are desirable, especially those that maintain their amphoteric character over most of the pH range of interest for cleaning hard surfaces. The sulfonate group is the normally preferred anionic group.

Preferred amphoteric/zwitterionic detergent surfactants have the generic formula:

$$R^3—[C(O)—N(R^4)—(CR^5{}_2)_n]_mN(R^6)_2(^+)—(CR^5{}_2)_p—Y(-)$$

wherein each $R^3$ is an alkyl, or alkylene, group containing from about 8 to about 20, preferably from about 10 to about 18, more preferably from about 10 to about 16, carbon atoms; each ($R^4$) and ($R^6$) is selected from the group consisting of hydrogen, methyl, ethyl, propyl, hydroxy substituted ethyl or propyl and mixtures thereof; each ($R^5$) is selected from the group consisting of hydrogen and hydroxy groups; m is 0 or 1; and each n and p is a number from 1 to about 4, more preferably about 3, there being no more than about one hydroxy group in any ($CR^5{}_2$) moiety; and wherein each Y is preferably a carboxylate ($COO^-$) or, more preferably, sulfonate. The $R^3$ groups can be branched and/or unsaturated, and such structures can provide spotting/filming benefits, even when used as part of a mixture with straight chain alkyl $R^3$ groups. The $R^4$ groups can also be connected to form ring structures. Preferred hydrocarbyl amidoalkylene sulfobetaine (HASB) detergent surfactants wherein m=1 and Y is a sulfonate group provide superior grease soil removal and/or filming/streaking and/or "anti-fogging" and/or perfume solubilization properties. Such hydrocarbylamidoalkylene betaines and, especially, hydrocarbylamidoalkylene sulfobetaines are excellent for use in hard surface cleaning detergent compositions, especially those formulated for use on both glass and hard-to-remove soils. They are even better when used with monoethanolamine and/or specific beta-amino alkanol as disclosed herein.

A more preferred specific detergent surfactant is a $C_{12-18}$ fatty acylamidopropylene(hydroxypropylene)-sulfobetaine, e.g., the detergent surfactant available from the Sherex Company as a 40% active product under the trade name "Rewoteric CAS Sulfobetaine."

The level of amphoteric/zwitterionic detergent surfactant, e.g., HASB, in the composition is typically from about 0.001% to about 15%, preferably from about 0.05% to about 10%, more preferably from about 0.1% to about 5%. The level in the composition is dependent on the eventual level of dilution to make the wash solution. For glass cleaning, the composition, when used full strength, or wash solution containing the composition, should contain from about 0.02% to about 1%, preferably from about 0.05% to about 0.5%, more preferably from about 0.1% to about 0.25%, of detergent surfactant. For removal of difficult to remove soils like grease, the level can, and should be, higher, typically from about 0.1% to about 10%, preferably from about 0.2% to about 2%. Concentrated products will typically contain from about 0.2% to about 10%, preferably from about 0.3% to about 5%. It is an advantage of the amphoteric/zwitterionic detergent, e.g., HASB, that compositions containing it can be more readily diluted by consumers since it does not interact with hardness cations as readily as conventional anionic detergent surfactants. Amphoteric/zwitterionic detergents are also extremely effective at very low levels, e.g., below about 1%.

Other amphoteric/zwitterionic detergent surfactants are set forth at Col. 4 of U.S. Pat. No. 4,287,080, Siklosi, incorporated herein by reference. Another detailed listing of suitable amphoteric/zwitterionic detergent surfactants for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, also incorporated herein by reference. The above patents and reference also disclose other detergent surfactants, e.g., anionic, and nonionic detergent surfactants, that can be used in small amounts in the composition of this invention as cosurfactants, as discussed hereinafter.

The Anionic Surfactant

The specific anionic surfactant herein has the generic formula:

$$R'(C_6H_3SO_3^-)—O—(C_6H_3SO_3^-)R'(nM)^{++}$$

wherein each R' is an alkyl, or alkylene, group containing from about 6 to about 12 carbon atoms, preferably from about 8 to about 10 carbon atoms, more preferably about 10 carbon atoms: M is a compatible cation, preferably an alkali metal, ammonium, or alkanolammonium cation, more preferably sodium; and n times the valence of M is equal to 2. These material s are available from Dow Chemical Corp. as Dowfax 3B2 and from Olin Corp. as Polytergent 3 B2.

These specific anionic surfactants are unique in their ability to solubilize relatively large amounts of relatively hydrophobic materials like perfume ingredients and cleaning solvents, in compositions, even when said specific anionic surfactant is used at relatively low levels. Typically, the level of the specific anionic surfactant is from about 0.01% to about 5%, preferably from about 0.05% to about 2%, more preferably from about 0.1% to about 0.8%. The level of this anionic surfactant is kept sufficiently low under conditions of use, e.g., less than about 0.5%, to minimize even the low level of filming/streaking associated with these surfactants. The specific anionic surfactant does not provide substantial cleaning ability.

In addition to the specific anionic surfactant, the composition can also contain a very small amount of additional anionic surfactant. Typically, the level is less than about 0.5%, preferably less than about 0.2%. Typical of these additional anionic detergent surfactants are the alkyl- and alkylethoxylate-(polyethoxylate) sulfates, paraffin sulfonates, olefin sulfonates, alpha-sulfonates of fatty acids and of fatty acid esters, and the like, which are well-known from the detergency art. When the pH is above about 9.5, detergent surfactants that are amphoteric at a lower pH are desirable anionic detergent cosurfactants. For example, detergent surfactants which are $C_{12}$–$C_{18}$ acylamido alkylene amino alkylene sulfonates, e.g., compounds having the formula $R—C(O)—NH—(C_2H_4)—N(C_2H_4OH)—CH_2CH(OH)CH_2SO_3M$ wherein R is an alkyl group containing from about g to about 18 carbon atoms and M is a compatible cation are desirable cosurfactants. These detergent surfactants are available as Miranol CS, OS, JS, etc. The CTFA adopted name for such surfactants is cocoamphohydroxypropyl sulfonate. It is preferred that the compositions be substantially free of alkyl naphthalene sulfonates.

In general, detergent surfactants useful herein contain a hydrophobic group, typically containing an alkyl group in the $C_9$–$C_{18}$ range, and, optionally, one or more linking groups such as ether or amido, preferably amido groups. The anionic detergent surfactants can be used in the form of their sodium, potassium or alkanolammonium, e.g., triethanolammonium salts. $C_{12}$–$C_{18}$ paraffin-sulfonates and alkyl sulfates are especially preferred in the compositions of the present type.

Some suitable surfactants for use in such cleaners are one or more of the following: sodium linear $C_8$–$C_{18}$ alkyl benzene sulfonate (LAS), particularly $C_{11}$–$C_{12}$ LAS; the sodium salt of a coconut alkyl ether sulfate containing 3 moles of ethylene oxide; the adduct of a random secondary alcohol having a range of alkyl chain lengths of from 11 to 15 carbon atoms and an average of 2 to 10 ethylene oxide moieties, several commercially available examples of which are Tergitol 15-S-3, Tergitol 15-S-5, Tergitol 15-S-7, and Tergitol 15-S-9, all available from Union Carbide Corporation; the sodium and potassium salts of coconut fatty acids (coconut soaps). Another suitable class of surfactants is the fluorocarbon surfactants, examples of which are FC-129, a potassium fluorinated alkylcarboxylate and FC-170-C, a mixture of fluorinated alkyl polyoxyethylene ethanols, both available from 3M Corporation, as well as the Zonyl fluorosurfactants, available from DuPont Corporation. It is understood that mixtures of various surfactants can be used.

Nonionic Detergent Surfactants

In addition to the amphoteric/zwitterionic detergent surfactant and the anionic surfactant, the compositions can also contain nonionic detergent surfactant. Examples of such nonionic detergent surfactants include: preferably, the condensation product of a straight-chain primary alcohol containing from about 8 carbons to about 16 carbon atoms and having an average carbon chain length of from about 10 to about 12 carbon atoms with from about 4 to about 8 moles of ethylene oxide per mole of alcohol; and an amide having one of the preferred formulas:

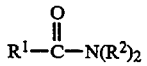

wherein $R^1$ is a straight-chain alkyl group containing from about 7 to about 15 carbon atoms and having an average carbon chain length of from about 9 to about 13 carbon atoms and wherein each $R^2$ is a hydroxy alkyl group containing from 1 to about 3 carbon atoms.

Surprisingly, it has been found that such detergent surfactants should be used at levels that provide a ratio of amphoteric/zwitterionic detergent surfactant to nonionic detergent surfactant of from about 4:3 to about 4:1, preferably from about 3:2 to about 3:1, more preferably about 2:1, especially when the pH is less than about 7. Higher and lower ratios of amphoteric/zwitterionic to nonionic detergent surfactant begin to lose cleaning advantages. Larger relative amounts of nonionic detergent surfactant tend to cause spotting/filming problems before losing cleaning effectiveness, whereas raising the relative amount of amphoteric/zwitterionic detergent surfactant tends to lose only the cleaning effectiveness.

Buffers

Alkaline Buffers such as Monoethanolamine and/or Beta-Aminoalkanol

Although monoethanolamine and/or beta-aminoalkanol compounds serve primarily as solvents when the pH is above about 10.0, and especially above about 10.7, they also provide alkaline buffering capacity during use. They also improve the spotting/filming properties of hard surface cleaning compositions containing amphoteric/zwitterionic detergent surfactant.

Monoethanolamine and/or beta-alkanolamine are used at a level of from about 0.05% to about 10%, preferably from about 0.2% to about 5%. For dilute compositions they are typically present at a level of from about 0.05% to about 2%, preferably from about 0.1% to about 1.0%, more preferably from about 0.2% to about 0.7%. For concentrated compositions they are typically present at a level of from about 0.5% to about 10%, preferably from about 1% to about 5%.

Preferred beta-aminoalkanol s have a primary hydroxy group. Suitable beta-aminoalkanols have the formula:

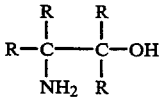

wherein each R is selected from the group consisting of hydrogen and alkyl groups containing from one to four carbon atoms and the total of carbon atoms in the compound is from three to six, preferably four. The amine group is preferably not attached to a primary carbon atom. More preferably the amine group is attached to a tertiary carbon atom to minimize the reactivity of the amine group. Specific preferred beta-aminoalkanols are 2-amino,1-butanol; 2-amino,2-methylpropanol; and mixtures thereof. The most preferred beta-aminoalkanol is 2-amino,2-methylpropanol since it has the lowest molecular weight of any beta-aminoalkanol which has the amine group attached to a tertiary carbon atom. The beta-aminoalkanols preferably have boiling points below about 175° C. Preferably, the boiling point is within about 5° C. of 165° C.

Good spotting/filming, i.e., minimal, or no, spotting-/filming, is especially important for cleaning of, e.g., window glass or mirrors where vision is affected and for dishes and ceramic surfaces where spots are aesthetically undesirable. Beta-aminoalkanols can provide superior cleaning of hard-to-remove greasy soils and superior product stability, especially under high temperature conditions, when used in hard surface cleaning compositions, especially those containing the zwitterionic detergent surfactants.

Acid Buffers such as Volatile Organic Acids

The compositions can also contain acid buffers. The acid buffers are carboxylic acids containing from one to about 3 carbon atoms, especially acetic acid. Substituted carboxylic acids tend to be less volatile, thus causing problems, especially on glass. These acid buffers are desirable to provide good cleaning of hard water stains and calcium soaps. However, when the pH is reduced below about 9, the cleaning of soils that contain fatty materials is reduced unless the solvent level is raised. The specific anionic surfactant discussed hereinbefore permits forming stable compositions containing relatively high levels of cleaning solvents, as described hereinafter, which provide improved cleaning without causing objectionable spotting/filming. The level of volatile short chain fatty acid is from about 0.5% to about 3%, preferably from about 1% to about 2%.

The buffer is selected to give a pH in the product and, at least initially, in use of from about 2 to about 13, preferably either alkaline (from about 9.7 to about 12, more preferably from about 9.7 to about 11.7), or acid (from about 2 to about 5, preferably from about 2.5 to about 4.5). pH is usually measured on the product. The buffering system, especially the alkaline buffering system, can comprise monoethanol amine and/or beta-aminoalkanol and, optionally, but preferably, cobuffer and/or alkaline material selected from the group consisting of: ammonia; other $C_2$–$C_4$ alkanolamines; alkali metal hydroxides; silicates; borates; carbonates; and/or bicarbonates; and mixtures thereof. The preferred optional buffering/alkalinity materials are alkali metal hydroxides. The level of the optional buffer/alkalinity-source is from 0% to about 5%, preferably from 0% to about 5%. Monoethanol amine and/or beta-aminoalkanol alkaline buffering material are preferred for spotting/filming.

The Cleaning Solvent

In order to obtain good cleaning without any appreciable amount of detergent builder, one can use a cleaning solvent. The cleaning solvents that can be employed in the hard surface cleaning compositions herein can be any of the well-known "degreasing" solvents commonly used in, for example, the dry cleaning industry, in the hard surface cleaner industry and the metalworking industry. The most effective sol vents tend to have a limited solubility in water, i.e., less than about 20%, preferably less than about 10%.

A useful definition of such solvents can be derived from the solubility parameters as set forth in "The Hoy," a publication of Union Carbide, incorporated herein by reference. The most useful parameter appears to be the hydrogen bonding parameter which is calculated by the formula $$\gamma H = \gamma T\left[\frac{\alpha - 1}{\alpha}\right]^{\frac{1}{2}}$$

wherein $\gamma H$ is the hydrogen bonding parameter, $\alpha$ is the aggregation number, $$(\text{Log } \alpha = 3.39066\ T_b/T_c - 0.15848 - \text{Log} M/d),$$

and $\gamma T$ is the solubility parameter which is obtained from the formula $$\gamma T = \left[\frac{(\Delta H_{25} - RT)d}{M}\right]^{\frac{1}{2}}$$

where $\Delta H_{25}$ is the heat of vaporization at 25° C., R is the gas constant (1.987 cal/mole/deg), T is the absolute temperature in °K., $T_b$ is the boiling point in °K., $T_c$ is the critical temperature in °K., d is the density in g/ml, and H is the molecular weight.

For the compositions herein, hydrogen bonding parameters are preferably less than about 7.7, more preferably from about 2 to about 7, and even more preferably from about 3 to about 6. Solvents with lower numbers become increasingly difficult to solubilize in the compositions and have a greater tendency to cause a haze on glass. However, the specific anionic surfactant disclosed herein can stabilize more of such solvents. Higher numbers require more solvent to provide good greasy/oily soil cleaning.

Cleaning solvents are typically used at a level of from about 1% to about 30%, preferably from about 2% to about 15%, more preferably from about 3% to about 8%. Dilute compositions typically have solvents at a level of from about 1% to about 10%, preferably from about 3% to about 8%. Concentrated compositions contain from about 10% to about 30%, preferably from about 10% to about 20% of solvent. The solvents herein have a relatively wide range of solubilities in water, but all have a solubility of less than about 20%, preferably less than about 15%. In general, less water soluble solvents tend to be more effective. However, in order to use the solvent at a given level, it should remain stably dispersed/solubilized in the composition. When the solvent is present at a level that tends to be unstable, either alone, or with other water insoluble components like perfume, additional ingredients are added to stabilize the composition. The specific anionic surfactant herein is not only effective in solubilizing the solvent and/or perfume, etc., but also has surprisingly good filming/streaking characteristics. It is this characteristic that allows one to use more solvent, either to provide superior cleaning on oily/greasy soils under alkaline conditions, or to minimize the loss of cleaning on such soils when acid conditions are used to promote cleaning of, e.g., soap scum, while maintaining filming/streaking characteristics that permit the compositions to be used even on glass.

Many of such solvents comprise hydrocarbon or halogenated hydrocarbon moieties of the alkyl or cycloalkyl type, and have a boiling point well above room temperature, i.e., above about 20° C., and preferably no higher than about 210° C. to obtain the most preferred filming/streaking performance.

The formulator of compositions of the present type will be guided in the selection of solvent partly by the need to provide good grease-cutting properties, and partly by aesthetic considerations. For example, kerosene hydrocarbons function quite well for grease cutting in the present compositions, but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6$–$C_9$ alkyl aromatic solvents, especially the $C_6$–$C_9$ alkyl benzenes, preferably octyl benzene, exhibit excellent grease removal properties and have a low, pleasant odor. Likewise, the olefin solvents having a boiling point of at least about 100° C., especially alpha-olefins, preferably 1-decene or 1-dodecene, are excellent grease removal solvents.

Generically, the glycol ethers useful herein have the formula $R^6O(R^7O)_mH$ wherein each $R^6$ is an alkyl group which contains from about 3 to about 8 carbon atoms, each $R^7$ is either ethylene or propylene, and m is a number from 1 to about 3. The most preferred glycol ethers are selected from the group consisting of monopropyleneglycolmonopropyl ether, dipropyleneglycolmonobutyl ether, monopropyleneglycolmonobutyl ether (including the t-butyl ether), diethyleneglycolmonohexyl ether, monoethyleneglycolmonohexyl ether, monoethyleneglycolmonobutyl ether, and mixtures thereof, preferably monopropyleneglycolmonobutyl ether.

Another type of solvent for these hard surface cleaner compositions comprises diols having from 6 to about 16 carbon atoms in their molecular structure. Preferred diol solvents have a solubility in water of from about 0.1 to about 20 g/100 g of water at 20° C.

Some examples of suitable diol solvents are: 1,4-cyclohexanedimethanol; 2,5-dimethyl-2,5-hexanediol; 2-phenyl-1,2-propanediol; phenyl-1,2-ethanediol; 2-ethyl-1,3-hexanediol; 2,2,4-trimethyl-1,3-pentanediol; and 1,2-octanediol.

The diol solvents can impart to the compositions an enhanced ability to remove calcium soap soils from surfaces such as bathtub and shower stall walls. These soils are particularly difficult to remove, especially for compositions which do not contain an abrasive. The diols containing 8–12 carbon atoms are preferred.

Solvents such as pine oil, orange terpene, benzyl alcohol, n-hexanol, phthalic acid esters of $C_{1-4}$ alcohols, butoxy propanol, Butyl Carbitol ® and 1(2-n-butoxy-1-methylethoxy)propane-2-ol (also called butoxy propoxy propanol or dipropylene glycol monobutyl ether), hexyl diglycol (Hexyl Carbitol ®), butyl triglycol, diols such as 2,2,4-trimethyl-1,3-pentanediol, and mixtures thereof, can be used. The butoxy-propanol solvent should have no more than about 20%, preferably no more than about 10%, more preferably no more than about 7%, of the secondary isomer in which the butoxy group is attached to the secondary atom of the propanol for improved odor.

The Aqueous Solvent System

The balance of the formula is typically water and non-aqueous polar solvents with only minimal cleaning action, e.g., those having a hydrogen bonding parameter above 7.8, like methanol, ethanol, isopropanol, ethylene glycol, propylene glycol, and mixtures thereof. The level of non-aqueous polar solvent is greater when more concentrated formulas are prepared. Typically, the level of non-aqueous polar solvent is from about 0% to about 40%, preferably from about 1% to about 10% and the level of water is from about 50% to about 99%, preferably from about 75% to about 95%.

Optional Ingredients

The compositions herein can also contain other various adjuncts which are known to the art for detergent compositions. Preferably they are not used at levels that cause unacceptable spotting/filming. Non-limiting examples of such adjuncts are:

Enzymes such as proteases;

Hydrotropes such as sodium toluene sulfonate, sodium cumene sulfonate and potassium xylene sulfonate; and Aesthetic-enhancing ingredients such as colorants and perfumes, providing they do not adversely impact on spotting/filming in the cleaning of glass. The perfumes are preferably those that are more water-soluble and/or volatile to minimize spotting and filming.

Antibacterial agents can be present, but preferably only at low levels to avoid spotting/filming problems. More hydrophobic antibacterial/germicidal agents, like orthobenzyl-para-chlorophenol, are preferably avoided. If present, such materials should be kept at levels below about 0.1%.

Detergent Builder

An optional ingredient for general cleaning purposes, is from 0% to about 30%, preferably from about 1% to about 15%, more preferably from about 1% to about 12%, of detergent builder. For use on glass and/or other shiny surfaces, a level of builder of from about 0.1% to about 0.5%, preferably from about 0.1% to about 0.2%, is useful. While any of the builders or inorganic salts can be used herein, some examples of builders for use herein are sodium nitrilotriacetate, potassium pyrophosphate, potassium tripolyphosphate, sodium or potassium ethane-1-hydroxyl-1,1-diphosphonate, the non-phosphorous chelating agents described in U.S. Pat. No. 5,202,050, Culshaw and Vos, issued Apr. 13, 1993, said patent being incorporated herein by reference (e.g., carboxymethyltartronic acid, oxydimalonic acid, tartrate monosuccinic acid, oxydisuccinic acid, tartrate disuccinic acid, and mixtures thereof), sodium citrate, sodium carbonate, sodium sulfite, sodium bicarbonate, and so forth.

Other suitable builders are disclosed in U.S. Pat. No. 4,769,172, Siklosi, issued Sep. 6, 1988, and incorporated herein by reference, and chelating agents having the formula:

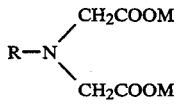

wherein R is selected from the group consisting of:

$-CH_2CH_2CH_2OH$; $-CH_2CH(OH)CH_3$;

$-CH_2CH(OH)CH_2OH$; $-CH(CH_2OH)_2$;

-continued $-CH_3$; $-CH_2CH_2OCH_3$; $-\underset{\underset{O}{\|}}{C}-CH_3$; $-CH_2-\underset{\underset{O}{\|}}{C}-NH_2$;

$-CH_2CH_2CH_2OCH_3$; $-C(CH_2OH)_3$;

and mixtures thereof; and each M is hydrogen or an alkali metal ion.

The levels of builder present in the wash solution used for glass should be less than about 0.5%, preferably less than about 0.2%. Therefore, dilution is highly preferred for cleaning glass, while full strength use is preferred for general purpose cleaning.

Other effective detergent builders, e.g., sodium citrate, sodium ethylenediaminetetraacetate, etc., can also be used, preferably at lower levels, e.g., from about 0.1% to about 1%, preferably from about 0.1% to about 0.5%.

Inclusion of a detergent builder improves cleaning, but harms spotting and filming and has to be considered as a compromise in favor of cleaning. Inclusion of a detergent builder is optional and low levels are usually more preferred than high levels.

Perfumes

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. It is a special advantage of this invention that perfume ingredients are readily solubilized in the compositions by the specific anionic surfactant and the other surfactants herein. Other similar surfactants will not solubilize as much perfume, especially substantive perfume, or maintain uniformity to the same low temperature.

The perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos.: 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. Normally, the art recognized perfume compositions are not very substantive as described hereinafter to minimize their effect on hard surfaces.

In general, the degree of substantivity of a perfume is roughly proportional to the percentages of substantive perfume material used. Relatively substantive perfumes contain at least about 1%, preferably at least about 10%, substantive perfume materials.

Substantive perfume materials are those odorous compounds that deposit on surfaces via the cleaning process and are detectable by people with normal olfactory acuity. Such materials typically have vapor pressures lower than that of the average perfume material.

Also, they typically have molecular weights of about 200 or above, and are detectable at levels below those of the average perfume material.

Perfumes can also be classified according to their volatility, as mentioned hereinbefore. The highly volatile, low boiling, perfume ingredients typically have boiling points of about 250° C. or lower. Many of the more moderately volatile perfume ingredients are also lost substantially in the cleaning process. The moderately volatile perfume ingredients are those having boiling points of from about 250° C. to about 300° C. The less volatile, high boiling, perfume ingredients referred to hereinbefore are those having boiling points of about 300° C. or higher. A significant portion of even these high boiling perfume ingredients, considered to be substantive, is lost during the cleaning cycle, and it is desirable to have means to retain more of these ingredients on the dry surfaces. Many of the perfume ingredients, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, cis-citral (neral), citronellal, citronellol, citronellyl acetate, para-cymene, decanal, dihydrolinalool, dihydromyrcenol, dimethyl phenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, myrcene, myrcenyl acetate, myrcenol, nerol, neryl acetate, nonyl acetate, phenyl ethyl alcohol, alphapinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of moderately volatile perfume ingredients are: amyl cinnamic aldehyde, iso-amyl salicylate, beta-caryophyllene, cedrene, cinnamic alcohol, coumarin, dimethyl benzyl carbinyl acetate, ethyl vanillin, eugenol, iso-eugenol, flor acetate, heliotropine, 3-cis-hexenyl salicylate, hexyl salicylate, lilial (para-tertiarybutyl-alpha-methyl hydrocinnamic aldehyde), gamma-methyl ionone, nerolidol, patchouli alcohol, phenyl hexanol, beta-selinene, trichloromethyl phenyl carbinyl acetate, triethyl titrate, vanillin, and veratraldehyde. Cedarwood terpenes are composed mainly of alpha-cedrene, beta-cedrene, and other $C_{15}H_{24}$ sesquiterpenes.

Examples of the less volatile, high boiling, perfume ingredients are: benzophenone, benzyl salicylate, ethylene brassylate, galaxolide (1,3,4,6,7,8-hexahydro-4,6,6,7,8,8-hexamethyl-cyclopenta-gama-2-benzopyran), hexyl cinnamic aldehyde, lyral (4-(4-hydroxy-4-methyl pentyl)-3-cyclohexene-10-carboxaldehyde), methyl cedrylone, methyl dihydro jasmonate, methyl-beta-naphthyl ketone, musk indanone, musk ketone, musk tibetene, and phenylethyl phenyl acetate.

Selection of any particular perfume ingredient is primarily dictated by aesthetic considerations, but more water-soluble materials are preferred, as stated hereinbefore, since such materials are less likely to adversely affect the good spotting/filming properties of the compositions. If the terpene types of perfume ingredients are used, the beta-aminoalkanols are preferred for product stability.

These compositions have exceptionally good cleaning properties. They can also be formulated to have good "shine" properties, i.e., when used to clean glossy surfaces, without rinsing.

The compositions can be formulated to be used at full strength, where the product is sprayed onto the surface to be cleaned and then wiped off with a suitable material like cloth, a paper towel, etc. They can be packaged in a package that comprises a means for creating a spray, e.g., a pump, aerosol propellant and spray valve, etc.

The invention is illustrated by the following Examples.

In the Examples, the following test is used to evaluate the products' filming/streaking performance.

Filming/Streaking Stress Test

Procedure:

A paper towel is folded into eighths. Two milliliters of test product are applied to the upper half of the folded paper towel. The wetted towel is applied in one motion with even pressure from top to bottom of a previously cleaned window or mirror. The window or mirror with the applied product(s) is allowed to dry for ten minutes before grading by expert judges. After initial grading, the residues are then buffed with a dry paper towel with a uniform, consistent motion. The buffed residues are then graded by expert judges.

Grading:

Expert judges are employed to evaluate the specific areas of product application for amount of filming/streaking. A numerical value describing the amount of filming/streaking is assigned to each product. For the test results reported here a 0–6 scale was used.

0=No Filming/Streaking

6=Poor Filming/Streaking

Room temperature and humidity have been shown to influence filming/streaking. Therefore these variables are always recorded.

EXAMPLE I

| Ingredient | Formula No.* (Wt. %) 1 | 2 | 3 | 4 |
|---|---|---|---|---|
| Propylene Glycol Monobutylether | 6.4 | 6.4 | 6.4 | 6.4 |
| Sodium Lauryl Sulfate | — | — | — | 0.26 |
| Cocoamidopropyl (Hydroxypropyl)sulfobetaine | 0.20 | 0.20 | 0.20 | 0.20 |
| Monoethanolamine | 0.7 | — | — | 0.7 |
| Ammonium Hydroxide | — | 0.4 | — | — |
| Acetic Acid | — | — | 1.5 | — |
| Dowfax 3B2 | 0.44 | 0.44 | 0.42 | — |
| Deionized Water | q.s. | q.s. | q.s. | q.s. |

Filming/Streaking Stress Test on Glass Windows
(Four Replications at 73° F. and 53% Relative Humidity)

| Formula No. | Before/After Buffing Rating |
|---|---|
| 1 | 1.75/1.17 |
| 2 | 2.42/3.17 |
| 3 | 1.00/3.00 |
| 4 | 3.92/1.25 |

The least significant difference between mean ratings is 0.8 at 95% confidence level.

EXAMPLE II

| Ingredient | Formula No.* (Wt. %) 1 | 2 | 3 |
|---|---|---|---|
| Cocoamidopropyl-dimethyl-2-hydroxy-3-sulfopropylbetaine | 0.1 | 0.2 | 0.3 |
| $C_{9-11}$ Alcohol Polyethoxylate(6) | 0.1 | 0.4 | 0.3 |
| Acetic Acid | 2.5 | 2.0 | 2.0 |
| Propylene Glycol Monobutylether | 3.0 | 3.0 | 3.0 |
| Isopropanol | 4.0 | 4.0 | 4.0 |
| Deionized Water | q.s. | q.s. | q.s. |

EXAMPLE II (Continued)

| Ingredient | Formula No.* (Wt. %) 4 | 5 | 6 |
|---|---|---|---|
| Cocoamidopropyl-dimethyl-2-hydroxy-3-sulfopropylbetaine | 0.4 | 0.6 | — |
| $C_{9-11}$ Alcohol Polyethoxylate(6) | 0.2 | — | 0.6 |
| Acetic Acid | 2.0 | 2.0 | 2.0 |
| Propylene Glycol Monobutylether | 3.0 | 3.0 | 3.0 |
| Isopropanol | 4.0 | 4.0 | 4.0 |
| Deionized Water | q.s. | q.s. | q.s. |

EXAMPLE II (Continued)

| Ingredient | Formula No.* (Wt. %) 7 | 8 | 9 | 10 |
|---|---|---|---|---|
| Propylene Glycol Monobutylether | 5.0 | 5.0 | 5.0 | 5.0 |
| $C_{9-11}$ Alcohol Polyethoxylate(6) | 0.24 | 0.20 | 0.15 | 0.10 |
| Cocoamidopropyl (Hydroxy-propyl)sulfobetaine | 0.36 | 0.40 | 0.45 | 0.50 |
| Acetic Acid | 1.0 | 1.0 | 1.0 | 1.0 |
| Polytergent 3B2 | 0.10 | 0.10 | 0.10 | 0.10 |
| Deionized Water | q.s. | q.s. | q.s. | q.s. |

Filming/Streaking Stress Test on Glass Windows (Four Replications at 73° F. and 53% Relative Humidity)

| Formula No. | Before/After Buffing Rating |
|---|---|
| 1 | 1.0/1.2 |
| 2 | 3.2/3.8 |
| 3 | 3.0/0.8 |
| 4 | 1.8/0.2 |
| 5 | 1.0/2.0 |
| 6 | 4.2/4.2 |
| 7 | 2.3/1.8 |
| 8 | 1.2/0.8 |
| 9 | — |
| 10 | — |

In the above Example, the following test is used to evaluate the products' cleaning performance.

Preparation of Soiled Panels

Enamel splash panels are selected and cleaned with a mild, light duty liquid cleanser, then cleaned with isopropanol, and rinsed with distilled or deionized water. Greasy-particulate soil is weighed (2.0 grams) and placed on a sheet of aluminum foil. The greasy-particulate soil is a mixture of about 77.8% commercial vegetable oils and about 22.2% particulate soil composed of humus, fine cement, clay, ferrous oxide, and carbon black. The soil is spread out with a spatula and rolled to uniformity with a small roller. The uniform soil is then rolled onto the clean enamel panels until an even coating is achieved. The panels are then equilibrated in air and then placed in a preheated oven and baked at 140° C. for 45–60 minutes. Panels are allowed to cool to room temperature and can either be used immediately, or aged for one or more days. The aging produces a tougher soil that typically requires more cleaning effort to remove.

Soil Removal

A Gardner Straight Line Washability Machine is used to perform the soil removal. The machine is fitted with a carriage which holds the weighted cleaning implement. The cleaning implements used for this testing were clean cut sponges. Excess water is wrung out from the sponge and 5.0 grams of product are uniformly applied to one surface of the sponge. The sponge is fitted into the carriage on the Gardner machine and the cleaning test is run.

The number of Gardner machine strokes necessary to achieve 9599% removal of soil are obtained.

| Formula No. | Number of Strokes |
|---|---|
| 7 | 16.3 |
| 8 | 15.7 |
| 9 | 18.3 |
| 10 | 22.0 |

*Four replicates, tough greasy-particulate soil.

The above shows that even with high levels of solvent, there is cleaning benefit from using ratios of amphoteric to nonionic detergent surfactant between about 1:1 and about 4:1, especially between about 1.5:1 and 3:1. The benefit is greater when lower levels of cleaning solvent are present.

The least significant difference between strokes is 2.10 at the 95% confidence level.

EXAMPLE III

| Ingredient | Formula No.* (Wt. %) 1 | 2 | 3 |
|---|---|---|---|
| Cocoamidopropyl-dimethyl-2-hydroxy-3-sulfopropylbetaine | 0.4 | 0.4 | 0.4 |
| $C_{9-11}$ Alcohol Polyethoxylate(6) | 0.2 | 0.2 | 0.2 |
| Acetic Acid | 2.0 | 2.0 | 2.0 |
| Propylene Glycol Monobutylether | 3.0 | 4.0 | 5.0 |
| Isopropanol | 6.0 | 4.0 | 3.0 |
| Deionized Water | q.s. | q.s. | q.s. |

| Formula No. | Number of Strokes |
|---|---|
| 1 | 26.0 |
| 2 | 19.7 |
| 3 | 12.0 |

*Three replicates, tough greasy-particulate soil.

The above shows that at acid pH's higher levels of solvent are required to provide superior cleaning benefits. The solvent is able to compensate, at least in part, for the lower level of cleaning that results from the use of the low pH.

The least significant difference between strokes is 2.5 at the 95% confidence level.

| Ingredient | Formula No.* (Wt. %) 1 | 2 | 3 |
|---|---|---|---|
| Cocoamidopropyl-dimethyl-2-hydroxy-3-sulfopropylbetaine | 0.4 | — | 0.4 |
| Cocoamidopropyl-dimethyl-betaine | — | 0.4 | — |
| $C_{9-11}$ Alcohol Polyethoxylate(6) | 0.2 | 0.2 | 0.2 |

-continued

| | | | |
|---|---|---|---|
| Polytergent 3B2 | 0.1 | 0.1 | — |
| Acetic Acid | 1.0 | 1.0 | 1.0 |
| Propylene Glycol Monobutylether | 5.0 | 5.0 | 5.0 |
| Deionized Water | q.s. | q.s. | q.s. |

| Formula No. | Number of Strokes |
|---|---|
| 1 | 24 |
| 2 | 23 |
| 3 | 24 |

*Four replicates, tough greasy-particulate soil.

The above shows that at acid pH's the normal betaine is essentially equal to the sulfobetaine and that the presence of the specific anionic surfactant does not appreciably improve cleaning when it is present, although it does provide a clearer composition.

The least significant difference between strokes is 4.8 at the 95% confidence level.

What is claimed is:

1. An aqueous liquid hard surface detergent composition comprising: (a) amphoteric detergent surfactant; (b) specific anionic surfactant herein having the generic formula:

$$R'(C_6H_3SO_3^-)—O—(C_6H_3SO_3^-)R'(nM)^{++}$$

wherein each R' is an alkyl, or alkylene, group containing from about 6 to about 12 carbon atoms, and M is a compatible cation, with n being selected to provide electrical neutrality; (c) cleaning solvent having a solubility in water of less than about 20%; and (d) the balance being an aqueous solvent system, the composition being unstable, due to the presence of (c), in the absence of (b), and the level of (b) being sufficient to maintain the stability of the composition.

2. The composition of claim 1 wherein said amphoteric detergent surfactant comprises from about 0.001% to about 15% of zwitterionic detergent surfactant.

3. The composition of claim 2 wherein said zwitterionic detergent surfactant has the formula:

$$R^3—[C(O)—N(R^4)—(CR^5{}_2)_n—]_mN(R^6)^{(+)}—(CR^5{}_2)_p—Y$$

wherein each $R^3$ is an alkyl, or alkylene, group containing from about 10 to about 18 carbon atoms, each ($R^4$) and ($R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, with no more than about one hydroxy group in any ($CR^5{}_2$) moiety; Y is a sulfonate or carboxylate group; m is 0 or 1; and each n and p is a number from 1 to about 4.

4. The composition of claim 3 wherein said zwitterionic detergent surfactant (a) comprises from about 0.02% to about 10% hydrocarbyl-amidoalkylenesulfobetaine which has the formula:

$$R^3—C(O)—N(R^4)—(CR^5{}_2)_n—N(R^6)_2^{(+)}—(CR^5{}_2)_p—SO_3^{(-)}$$

wherein each $R^3$ is an alkyl, or alkylene, group containing from about 10 to about 18 carbon atoms, each ($R^4$) and $R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, and each n and p is a number from 1 to about 4; with no more than about one hydroxy group in any ($CR^5{}_2$) moiety.

5. The composition of claim 2 wherein said zwitterionic detergent surfactant (a) comprises from about 0.001% to about 15% hydrocarbyl-amidoalkylenebetaine which has the formula:

$$R^3—C(O)—N(R^4)—(CR^5{}_2)_n—N(R^6)_2^{(+)}—(CR^5{}_2)_p—COO^{(-)}$$

wherein each $R^3$ is an alkyl, or alkylene, group containing from about 10 to about 18 carbon atoms, each ($R^4$) and ($R^6$) is selected from the group consisting of hydrogen, methyl, ethyl, propyl, hydroxy substituted ethyl or propyl and mixtures thereof, each ($R^5$) is selected from the group consisting of hydrogen and hydroxy groups, and each n and p is a number from 1 to about 4; with no more than about one hydroxy group in any ($CR^5{}_2$) moiety.

6. The composition of claim 5 wherein: said $R^3$ group contains from about 9 to about 15 carbon atoms; $R^4$ is hydrogen; $R^6$ is methyl; n is 3; and p is 1.

7. The composition of claim 1 wherein R' in (b) contains from about 8 to about 10 carbon atoms and M is sodium.

8. The composition of claim 1 containing from about 0.01% to about 5% of (b).

9. The composition of claim 8 containing from about 0.05% to about 2% of (b).

10. The composition of claim 8 containing from about 0.1% to about 0.8% of (b).

11. The composition of claim 8 wherein R' in (b) contains from about 8 to about 10 carbon atoms and M is sodium.

12. The composition of claim 1 containing at least one cosurfactant.

13. The composition of claim 12 wherein said cosurfactant is a nonionic detergent surfactant and the ratio of (a) to said cosurfactant is from about 4:3 to about 4:1.

14. The composition of claim 13 wherein the ratio of (a) to said cosurfactant is from about 3:2 to about 3:1.

15. The composition of claim 14 wherein the ratio of (a) to said cosurfactant is about 2:1.

16. The composition of claim 14 wherein said composition contains a volatile organic acid to provide a pH of from about 2 to about 5.

17. The composition of claim 16 wherein said composition contains a volatile organic carboxylic acid to provide a pH of from about 2.5 to about 4.5.

18. The composition of claim 12 wherein said composition contains a volatile organic acid to provide a pH of from about 2 to about 5.

19. An aqueous liquid hard surface detergent composition comprising: (a) amphoteric detergent surfactant; (b) nonionic detergent surfactant the ratio of (a) to said cosurfactant being from about 4:3 to about 4:1; (c) specific anionic surfactant having the formula:

$$R'(C_6H_3SO_3^-)—O—(C_6H_3SO_3^-)R'(nM)^{++}$$

wherein each R' is an alkyl, or alkylene, group containing from about 6 to about 12 carbon atoms, and M is a compatible cation, with n being selected to provide electrical neutrality; (d) cleaning solvent having a solubility in water of less than about 20%; and (e) the balance being an aqueous solvent system.

20. The composition of claim 15 wherein the ratio of (a) to (b) is from about 3:2 to about 3:1.

21. The composition of claim 19 wherein the pH is from about 2 to about 5 and the solvent (c) is present at a level that is greater than about 4%.

22. The composition of claim 1 wherein the pH is from about 9.7 to about 12.

23. The composition of claim 22 wherein the pH is from about 9.7 to about 11.7.

24. The composition of claim 22 which is substantially free of nonionic cosurfactant.

* * * * *